US005558553A

United States Patent [19]

Okano

[11] Patent Number: 5,558,553

[45] Date of Patent: Sep. 24, 1996

[54] WATER WALKING DEVICE, HULL AND STOCK THEREOF

[76] Inventor: Kiyoshige Okano, 187-5 Kawajiri, Siroyama-cho, Tsukui-gun, Kanagawa-Ken, Japan

[21] Appl. No.: 537,456

[22] Filed: Oct. 2, 1995

[51] Int. Cl.[6] ..... B63B 35/83

[52] U.S. Cl. ..... 441/76; 440/101

[58] Field of Search ..... 441/76, 77, 65, 441/79, 74, 72, 73; 440/17, 101

[56] References Cited

U.S. PATENT DOCUMENTS

| | | | |
|---|---|---|---|
| 3,027,576 | 4/1962 | Fines | 441/76 |
| 3,566,427 | 3/1971 | Davis et al. | 441/76 |
| 3,750,203 | 8/1973 | Ceccato | 441/76 |
| 4,184,216 | 1/1980 | Saleen | 441/93 |
| 4,618,329 | 10/1986 | Celez | 441/76 |
| 4,985,006 | 1/1991 | Brunet | 441/76 |
| 5,080,621 | 1/1992 | Nayes | 441/76 |

FOREIGN PATENT DOCUMENTS

| | | | |
|---|---|---|---|
| 2376672 | 9/1978 | France | 441/77 |

*Primary Examiner*—Edwin L. Swinehart
*Attorney, Agent, or Firm*—Andrus, Sceales, Starke & Sawall

[57] ABSTRACT

A water walking device consisting of a pair of hulls with footwells, and a pair of stocks. A water surface blade at the rear of the hull is formed in a concave shape pointing towards the front of the hull. The underwater blade at the rear of the vertical stabilizer fin, is formed in a fan shape towards the rear of the vertical stabilizer fin, and the rear surface of said underwater blade is formed in a concave shape pointing to the forward part of the vertical stabilizer fin. The blade sections on the stock consist of the blade body formed in a rim shape, and vanes formed on the lower part of this blade body. A plurality of these vanes form a radial pattern, at fixed intervals, centering around the shaft of the stock.

5 Claims, 5 Drawing Sheets

WATER WALKING DEVICE, HULL AND STOCK THEREOF

BACKGROUND OF THE INVENTION

1. Field of the Invention

This invention relates in general to aquatic recreational or sports equipment for movement over water surfaces and more particularly to a water walking device, and a pair of hulls and stocks thereof.

2. Description of the Related Art

Conventional types of water walking devices are for instance, the invention of laid open U.S. Pat. No. 4,985,006. In this conventional device, the lower part of the hull for walking on water was provided with a finkeel consisting of weights formed as a vertical stabilizer fin. However this device had no special structural points formed on the hull to obtain propulsion. As a result, in this kind of conventional device, the propulsion was mainly obtained from the stocks, so that considerable arm power was necessary for walking on the water thus having the drawback that a great amount of labor was needed.

However walking on water is performed on an unstable floating medium and buoyancy is required so that formation of a long snow ski shape is customary. Therefore, when walking on water, the user cannot raise his legs as done when walking on land and must slide along the surface of the water.

Furthermore, as is typically described in the invention of laid open U.S. Pat. No. 5,080,621, flaps are formed on the lower surface of the hull used for walking on water, in order to obtain propulsion. This method has the consequent drawback that when the arms are moved forward the flaps receive a large resistance from the water, conversely making walking on the water difficult.

The stocks used in these conventional device had no special structures on the blades on the lower part of the shaft for securely grabbing the water. Consequently, these kind of stocks could not securely paddle the water and balance could not be retained while walking.

SUMMARY OF THE INVENTION

The water walking device of this invention consists of a pair of hulls with footwells, and a pair of floatable stocks.

The rear of the hull has a concave water surface blade pointing towards the front of the hull. The water surface blade of this invention does not receive resistance from the water when walking, but instead securely grabs the water to obtain propulsion. The water surface propulsion blade is able to achieve these effects because there are no protrusions below or to the rear of the hull.

The underwater blade at the rear of the vertical stabilizer fin on the lower surface of the hull, is formed in a fan shape towards the rear of the vertical stabilizer fin, and the rear surface of said underwater blade is formed in a concave shape pointing to the forward part of the vertical stabilizer fin. Consequently the hull of this invention, water can flow from the vertical stabilizer fin along the underwater blade during walking. In this invention therefore, this effect allows the hull to move forward since the resistance of the water is extremely slight and further, the rear surface of the underwater propulsion blade can securely grasp the water.

The blade sections formed on the stock consist of the blade body formed in a rim shape, and vanes formed on the lower part of this blade body. A plurality of these vanes form a radial pattern, at fixed intervals, centering around the shaft of the stock. Consequently when the user thrusts the stock rearward into the surface of the water, the vanes on the stock of this invention can securely grasp the water. Therefore a result of using the water walking device of this invention is that walking on the water is pleasant and easy to accomplish.

DESCRIPTION OF THE PREFERRED EMBODIMENTS

Figure 1:
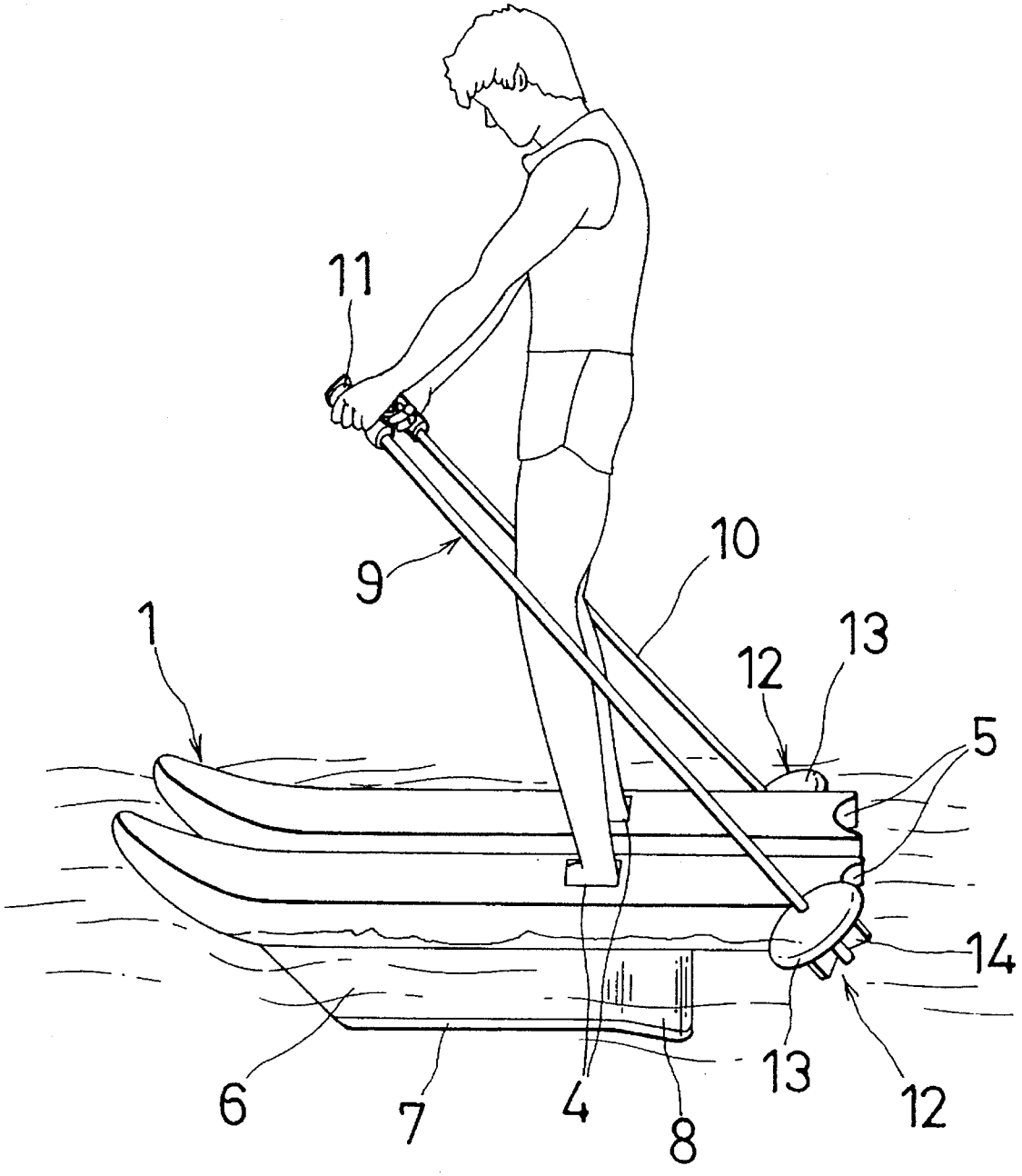
FIG. 1 is a perspective view of this invention while in use.
Figure 2:
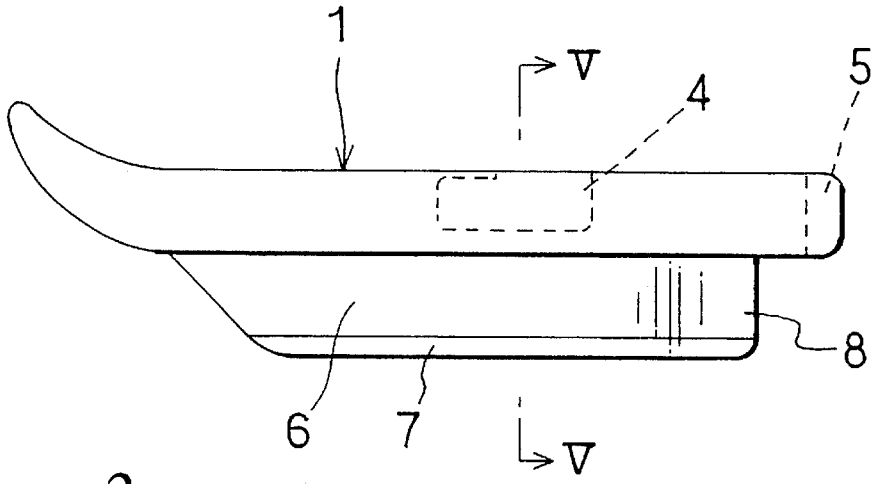
FIG. 2 is a side view of the hull with footwell.

An embodiment of this invention will be described next while referring to the drawings.

Figure 5:
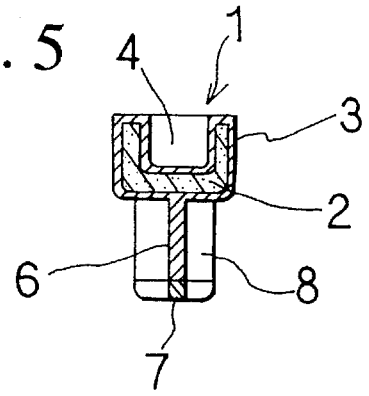
FIG. 5 is a cross-sectional view taken along lines V—V of FIG. 2.
Figure 6:
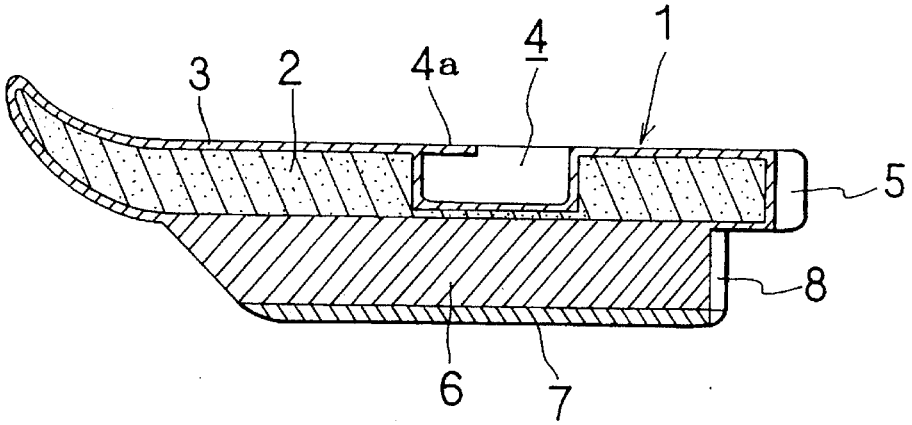
FIG. 6 is a cross-sectional view taken along lines VI—VI of FIG. 3.

A pair of hulls 1 having footwells, are formed in the shape of skis. The pair of hulls, as can be seen in FIG. 5 and FIG. 6 may have for instance, a foam surface 2 covered with a layer of the fiberglass 3. Styrene foam is preferable for use as the foam material 2 but other materials such as polyurethane foam or polystyrene foam may be used. The outer shape of the hull 1 of this invention was formed in the shape of a ski but need not be restricted to this shape.

Figure 3:
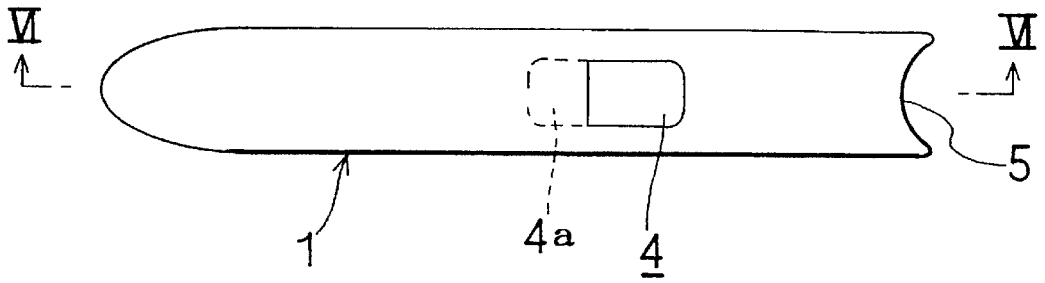
FIG. 3 is a top view of the hull with footwell.

A footwell 4 is formed in the hull 4. This footwell 4 is formed as a concave hole shape in approximately the center of the upper surface of the hull 1. In this case, forming of a cover position 4*a* is preferable in order to enclose the top of the foot to prevent the foot from coming loose from the hull 1 as shown in FIG. 3 and FIG. 6. A band or fastener may be used instead of the cover position 4*a*, in order to secure the foot.

The water surface propulsion blade 5 is formed at the rear of the hull 1. This water surface blade 5 is formed in a concave shape pointing towards the front of the hull 1. This concave shape is preferably curved but this invention need not be limited to that shape, with for instance a crooked shape also allowable.

The vertical stabilizer fin 6 on the bottom of the hull 1 is formed to extend in the longitudinal direction of the hull 1. A weight 7 is provided along the lower edge of the vertical stabilizer fin 6. This weight 7 is provided for balance, to allow the hull i to float horizontally on the water surface.

Figure 4:
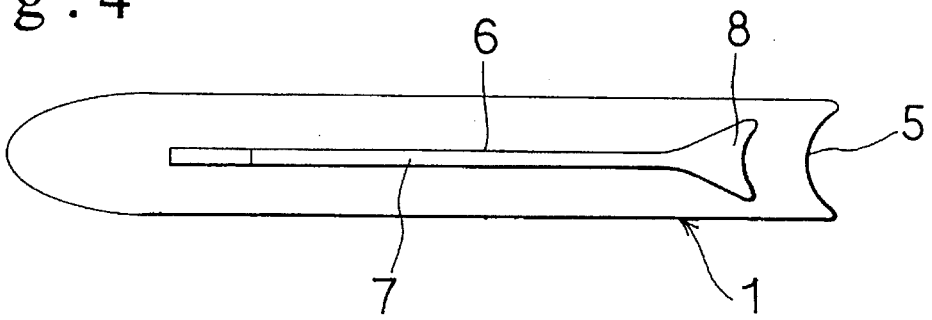
FIG. 4 is a bottom view of the hull with footwell.

The underwater propulsion blade 8 as shown in FIG. 4, is formed in a fan shape towards the rear of the vertical stabilizer fin 6, and the rear surface of said underwater blade 8 is formed in a concave shape pointing to the forward part of the vertical stabilizer fin 6. This concave shape is preferably curved but this invention need not be limited to that shape, with for instance a crooked shape also allowable. The underwater blade 8 at the rear of the vertical stabilizer fin 6 may also be formed in a bifurcated shape.

The pair of floating stocks 9 is used along with the hull 1 when water walking. On this stock 9, a grip 11 is provided at the top of the shaft 10 formed in a hollow shape, and the blade section 12 are formed on the lower part of the shaft 10.

Figure 7:
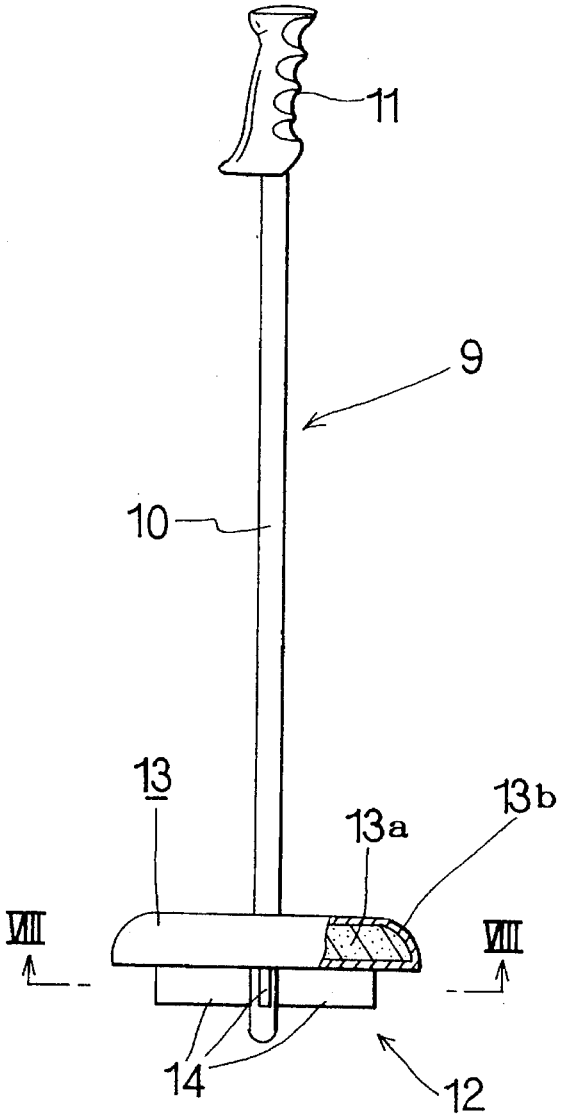
FIG. 7 is a front partial cutaway view of the stock.
Figure 8:
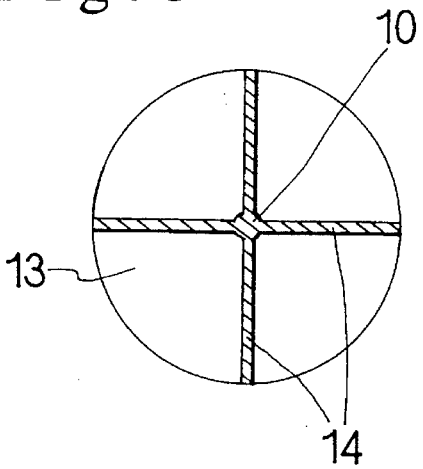
FIG. 8 is a cross-sectional view taken along lines VIII—VIII of FIG. 7.

The blade section 12 on the stock 9 consists of the blade body 13 formed in a rim shape, and the vanes 14 formed on the lower part of this blade body 13. The blade body 13 can be formed for instance, in a disk shape of the styrene foam 13 as shown in FIG. 7 and FIG. 8 and of a surface coated with the fiberglass 13*b*. A plurality of these vanes 14, as for instance the four vanes in FIG. 8, form a radial pattern, at fixed intervals, centering around the shaft 10 of the stock 9.

In order to use this invention, the user as shown in FIG. 1 inserts his feet into the footwells 4 of the hulls 1 and mounts both feet in the hulls 1. Next the grips 11 of the stocks 9 are grasped in the hands. While retaining his balance in this position with the stocks 9, the user alternately moves both legs and also paddles the water with the stocks 9 to walk on the water surface.

This invention, as explained previously, has a water surface blade 5 and an underwater blade 8 formed on the hull 9. This invention can therefore grasp and move water, both on the water surface, and below the water surface. During forward movement, there is little resistance from the water, since the water surface blade 5 is formed in a concave shape at the rear of hull 1 pointing forwards.

The underwater blade 8, is formed in a fan shape towards the rear of the vertical stabilizer fin 6, and the rear surface of the underwater blade 8 is formed in a concave shape pointing to the forward part of the vertical stabilizer fin 6. The water can therefore flow along the vertical stabilizer 8 with greatly reduced resistance to the water compared to conventional water walking devices having numerous flaps protruding from the bottom surface of the hull 1.

This invention also has numerous vanes 14 formed at fixed intervals and radiating from the center of the shaft 10 on the lower surface of blade body 13 on the stock 9. These vanes 14 can therefore securely grasp the water so that when the stock 9 is thrust into the water, so reliable propulsion is obtained with no slipping on the water surface. As a result, using the water walking device of this invention makes walking on the water surface and extremely easy and pleasant process.

Figure 9:
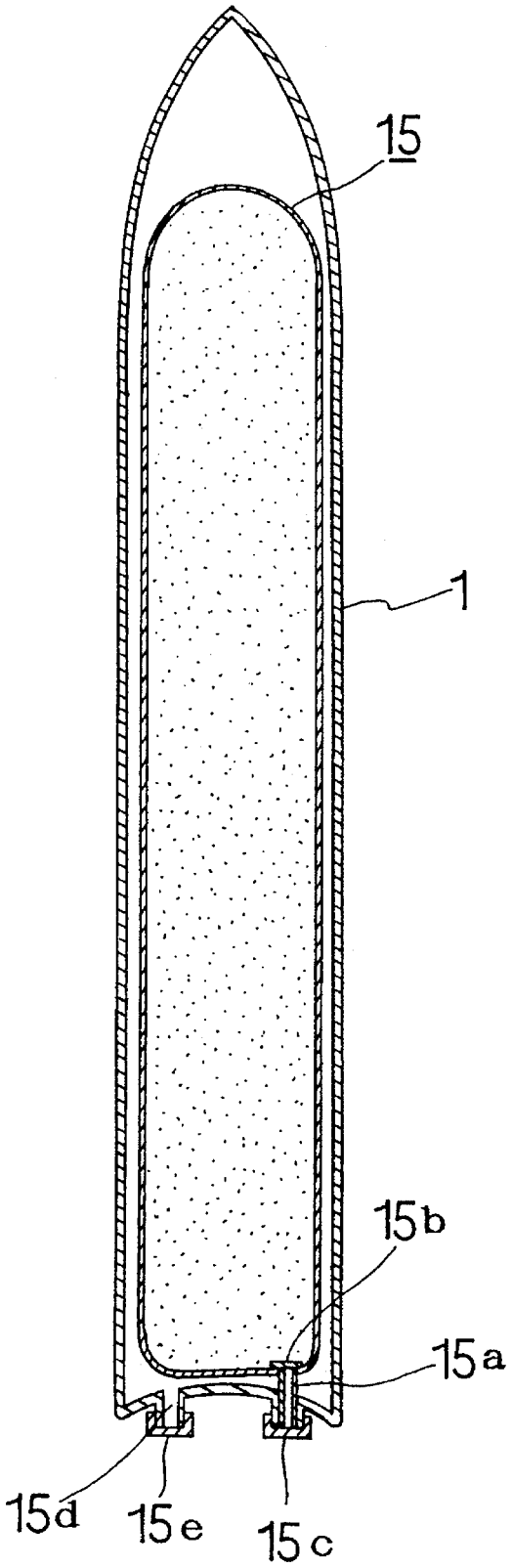
FIG. 9 is a horizontal cross-sectional view showing another embodiment of the hull.

In this invention, the said hull 1 for the above function may be formed in the shape shown in FIG. 9.

The hull 1 of FIG. 9 is provided with a buoyant bag 15 made of, for instance rubber or vinyl chloride resin. This interior of this buoyant bag 15 may be inflated for instance with a gas such as air or helium from the inlet 15*a* provided at the rear side of the hull 1.

In FIG. 9, a stop valve 15*b* and a seal cap 15*c* are provided. An air outlet 15*d* is provided to permit the escape of air from the hull 1 from the inflated buoyant bag 15. This air outlet 15*d* is sealed tight by the cap 15*e* after the buoyant bag 15 has been inflated.

The air outlet 15*d* position may for instance, be formed on the upper surface of the hull 1. There is no particular necessity for forming this air outlet 15*d* on the rear of the hull 1. The reason being, that the air inside the hull 1 will be pushed out through the opened end at the rear of the hull 1 when the buoyant bag 15 is inflated.

Figure 10:
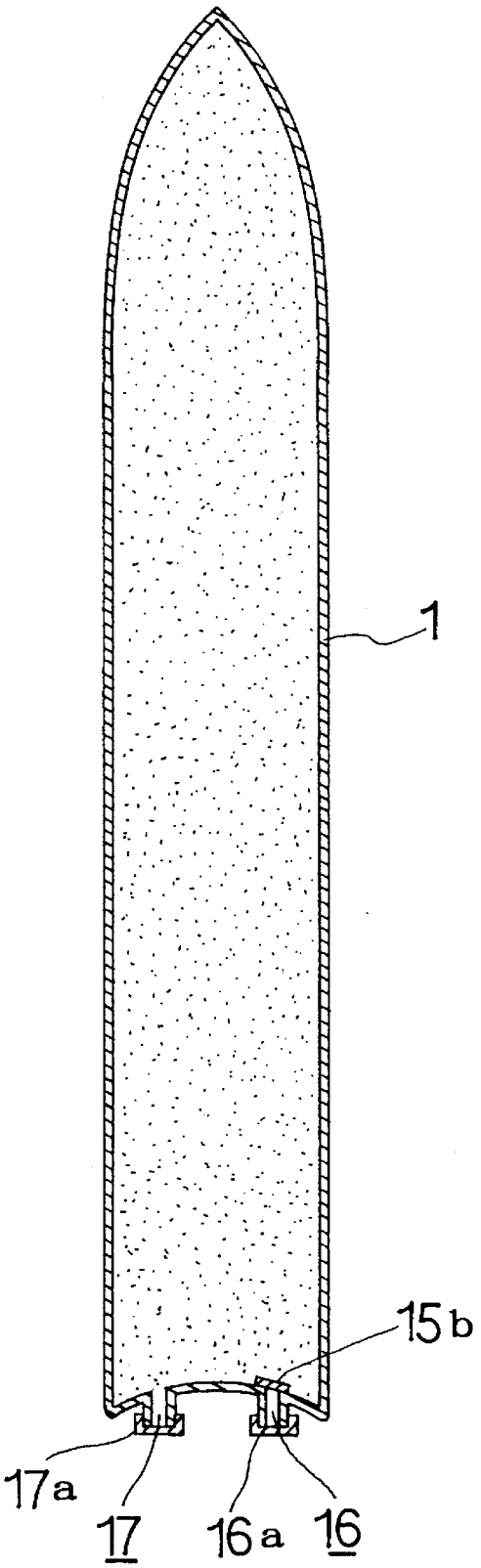
FIG. 10 is a horizontal cross-sectional view showing still another embodiment of the hull.

The hull 1 as shown in FIG. 10, may be made of a non-porous material such as rubber or plastic and formed in a hollow, air-tight shape. The air insertion inlet 16 with stop valve 15*b*, and the air release outlet 17 may be provided on the rear surface. In this case, the air release outlet 17 is sealed tight by means of the cap 17*a*.

Figure 11:
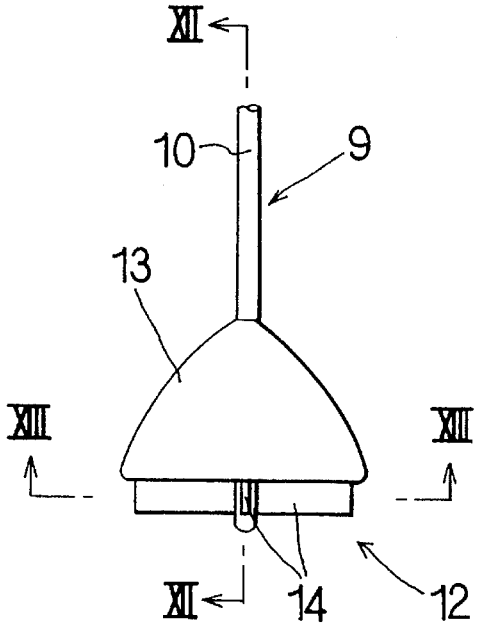
FIG. 11 is an essential front view showing another embodiment of the stock.
Figure 12:
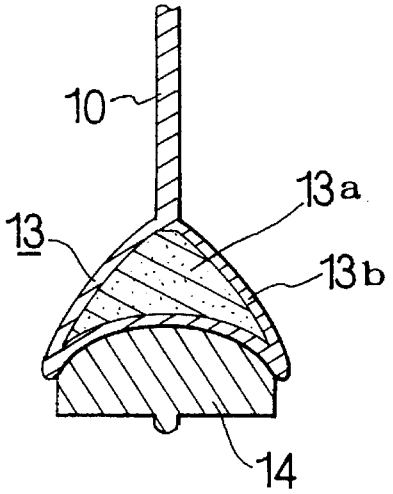
FIG. 12 is a cross-sectional view taken along lines XII—XII of FIG. 11.
Figure 13:
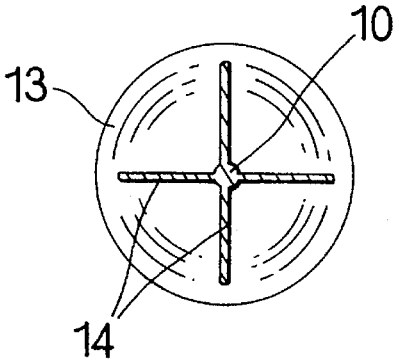
FIG. 13 is a cross-sectional view taken along lines XIII—XIII of FIG. 11.
Figure 14:
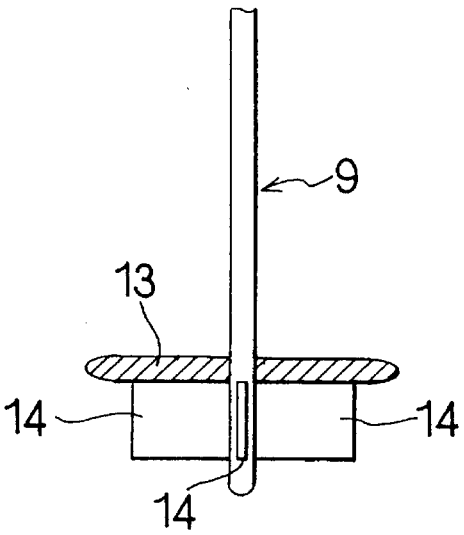
FIG. 14 is an essential front view showing still another embodiment of the stock.

The blade body 13 of the stock 9 as shown in FIG. 11 and FIG. 14, can be formed for instance in a cone shape or a disc shape. The blade body 13 as shown in FIG. 14 may be formed merely of pure plastic. The vanes 14 may be formed in four pieces to securely and accurately grasp the water whether the stock 9 is thrust in the water to the front, the rear or sideways.

What is claimed is:

1. A water walking device comprising:

(a) a pair of hulls, (b) a pair of stocks used with said hulls when walking on water, (c) each of said hulls having a footwell formed in a concave hole shape for mounting the feet of a user, (d) a vertical stabilizer fin on the lower surface of each hull formed to extend in the longitudinal direction, (e) a weight along the lower edge of each vertical stabilizer fin, (f) a water surface propulsion blade at the rear of the hull formed in a concave shape pointing towards the front of the hull, (g) an underwater propulsion blade at the rear of the vertical stabilizer fin formed in a fan shape divergent towards the rear of the vertical stabilizer fin to define a rear surface, and the rear surface of said underwater blade formed in a concave shape pointing to the forward part of the vertical stabilizer fin, (h) each stock including a shaft provided on the lower part with a plurality of vanes mounted in a blade body formed in a rim shape, (i) said vanes forming a radial pattern, at fixed intervals, centering around the shaft of the stock.

2. The water walking device of claim 1 wherein the interior of said hull is provided with a buoyant bag, an inlet for inserting gas into said buoyant bag, said inlet provided with a sealing cap.

3. The water walking device of claim 1 wherein said hull is made of a non-porous material and including an interior formed in a hollow, air-tight shape, and further including an air insertion inlet with a stop valve, and an air release outlet, said inlet and outlet attached to the hull in communication with the interior and provided with respective sealing caps on the rear surface.

4. The water walking device of claim 1 wherein said stocks are floatable.

5. A pair of stocks as recited in claim 4 having four vanes each.

* * * * *